United States Patent [19]

Takigawa

[11] 4,298,767

[45] Nov. 3, 1981

[54] SUPPORT FOR A HEATING ELEMENT IN AN ELECTRIC FURNACE

[75] Inventor: Seiichi Takigawa, Nagoya, Japan

[73] Assignee: Taki Industries Co., Ltd., Japan

[21] Appl. No.: 161,684

[22] Filed: Jun. 23, 1980

[30] Foreign Application Priority Data

Jun. 26, 1979 [JP] Japan ..... 54-80988

[51] Int. Cl.[3] ..... F27D 1/10; H05B 3/06

[52] U.S. Cl. ..... 13/25

[58] Field of Search ..... 13/20, 25, 35; 110/336; 219/98

[56] References Cited

U.S. PATENT DOCUMENTS

| | | | |
|---|---|---|---|
| 3,363,889 | 1/1968 | Shirley et al. | 13/35 X |
| 3,909,907 | 10/1975 | Davis | 13/25 UX |
| 4,032,742 | 6/1977 | Kendrick et al. | 219/98 X |
| 4,088,825 | 5/1978 | Carr | 13/35 X |
| 4,154,975 | 5/1979 | Sauder | 13/25 |
| 4,156,792 | 5/1979 | McFadden | 13/25 |
| 4,189,978 | 2/1980 | Mauer | 219/98 |

*Primary Examiner*—Roy N. Envall, Jr.

[57] ABSTRACT

Disclosed herein is a support for a heating element in an electric furnace. The support comprises a cylindrical holder made of heat resisting metal and fixed to the wall surface of the electric furnace, a pair of separated insulators secured within the cylindrical holder, a stud bolt made of heat resisting metal and a hook insulator mounted to the stud bolt for hanging the heating element. The insulators have central holes respectively, and one end of the stud bolt is detachably engaged with a member provided within one of the insulators through the central holes, and heat insulating layers are laminated on the wall surface of the electric furnace over the other end of the stud bolt.

9 Claims, 18 Drawing Figures

Fig 6
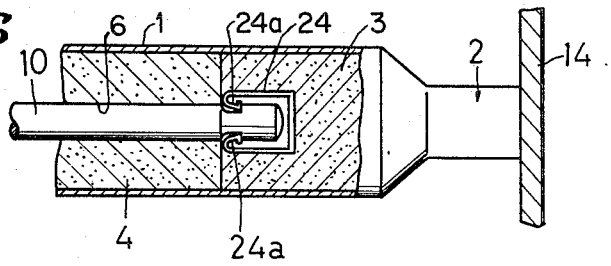
Fig 7
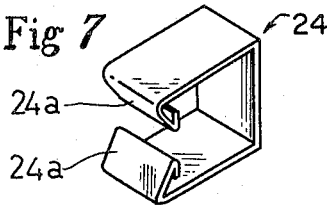
Fig 11
Fig 8
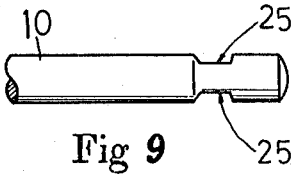
Fig 9
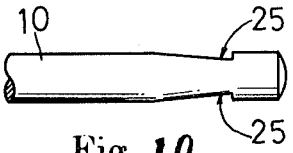
Fig 10
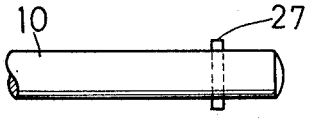
Fig 14
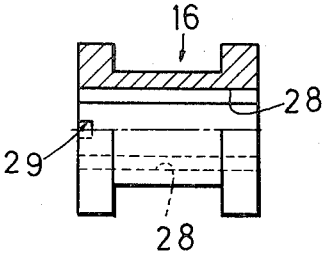
Fig 12
Fig 13
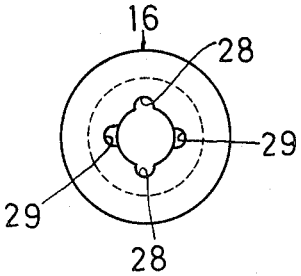
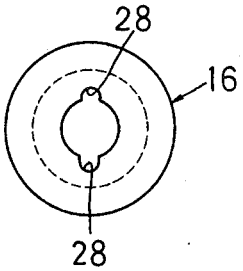
Fig 15
Fig 16
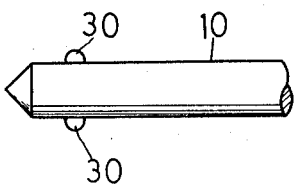
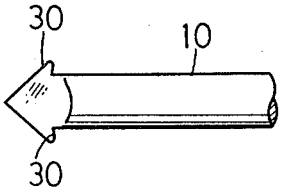
Fig 17
Fig 18
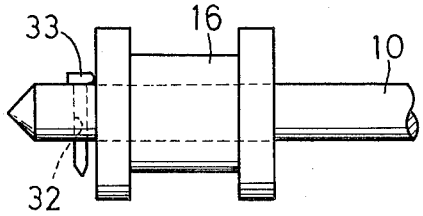
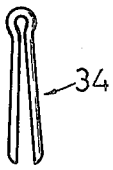
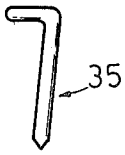

SUPPORT FOR A HEATING ELEMENT IN AN ELECTRIC FURNACE

BACKGROUND OF THE INVENTION

1. Field of the Invention

The present invention relates to a support for a heating element in an electric furnace, and more particularly, it relates to a support for hanging a metallic heating element such as nichrome wire and Kanthal wire and for securing heat insulating material such as ceramic fiber laminated on the inner surface of the furnace wall.

2. Description of the Prior Art

A conventional support for a metallic heating element generally comprises a hanger pin made of heat-resisting metal such as stainless steel and fixed to the inner surface of the furnace wall by a method such as welding and a hook insulator mounted to the hanger pin for hanging the metallic heating element such as nichrome wire. However, in case the hanger pin contacts the nichrome wire by breakage or displacement of the hook insulator, the nichrome wire causes a leak of electricity to the furnace wall through the metallic hanger pin.

SUMMARY OF THE INVENTION

An object of the present invention is to overcome the aforementioned disadvantage of the prior art by providing a novel and improved support for a heating element in an electric furnace in which the heating element such as nichrome wire is doubly insulated from the furnace wall for maintaining safety and preventing heat transferring through the hanger pin.

Another object of the present invention is to provide a novel and improved support for a heating element in an electric furnace in which a stud bolt functioning as the conventional hanger pin is easily assembled and replaced and a hook insulator is easily replaced.

According to the present invention, there is provided a support for a heating element in an electric furnace which comprises a cylindrical holder made of heat resisting metal and fixed to the furnace wall, a pair of insulators secured within the cylindrical holder, a stud bolt made of heat resisting metal which is engaged at one end with central holes of the insulators and passes at the other end through heat insulating layers laminated on the inner surface of the furnace wall and a hook insulator mounted to the other end of the stud bolt for hanging the heating element.

BRIEF EXPLANATION OF THE DRAWINGS

FIG. 6 is a cross sectional view showing another embodiment in which a stud bolt is secured to the cylindrical holder;

FIG. 7 is a perspective view of a set member;

FIGS. 8 to 10 are side elevational views respectively showing one end of the stud bolt of other embodiments;

FIG. 11 is a partially fragmentary side elevational view of the hook insulator of other embodiment;

FIGS. 12 and 13 are front and rear elevational views of the hook insulator of FIG. 11;

FIGS. 14 and 15 are side elevational views of the forward end of the stud bolt over which the hook insulator of FIG. 11 is put;

FIG. 16 is a side elevational view of the hook insulator of still another embodiment applied to the stud bolt;

FIG. 17 is a side elevational view of a split pin; and

FIG. 18 is a side elevational view of an L-shaped pin.

DESCRIPTION OF THE PREFERRED EMBODIMENTS

Figure 1:
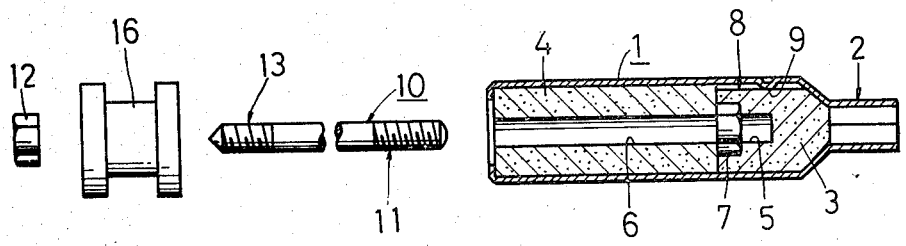
FIG. 1 is an exploded partially fragmentary side elevational view of a support according to the present invention.
Figure 2:
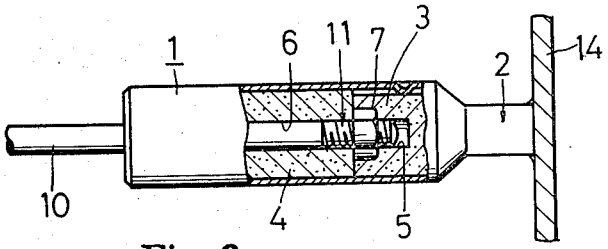
FIG. 2 is a partially fragmentary side elevational view of the support of FIG. 1 applied to the furnace wall.
Figure 3:
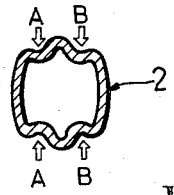
FIG. 3 is an illustrative view showing the method for contracting the head of the cylindrical holder.
Figure 4:
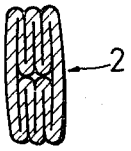
FIG. 4 is an enlarged end elevational view of the forward end of the head of the cylindrical holder.

Referring now to FIGS. 1 to 5 of the drawings in which an embodiment of the present invention is shown, numeral 1 indicates a cylindrical holder made of heat-resisting metal such as stainless steel, of which head 2 integrally provided on one end thereof is pressed at two portions from both sides to be in some degree flat as shown in section in FIG. 4. When being formed, the originally-cylindrical head 2 is pressed from outside at opposite two portions A and B as shown in FIG. 3 to be contracted and suited for welding as hereinafter described.

A pair of separated insulators 3 and 4 are inserted within the cylindrical holder 1. The insulators 3 and 4 respectively have central holes 5 and 6 communicating with each other, and a nut 7 coaxial with the holes 5 and 6 and prevented from rotating is provided within the insulator 3 which is shown in the righthand direction in FIGS. 1 and 2. A groove 8 is provided in the outer periphery of the insulator 3 having the nut 7 to be engaged with a projection 9 provided in the inner periphery of the cylindrical holder 1 to prevent relative rotation of the insulator 3 and the cylindrical holder 1. The periphery of the other end of the cylindrical holder 1, i.e., the end which is shown in the left-hand direction in FIGS. 1 and 2 is bent inwardly to prevent displacement of the insulators 3 and 4.

Numeral 10 indicates a stud bolt made of heat resisting metal such as stainless steel, and is provided separately from the cylindrical holder 1. One end of the stud bolt 10 is threaded at 11 to be engaged with the nut 7, and the other end is tapered and threaded at 13 to be engaged with another nut 12.

Figure 5:
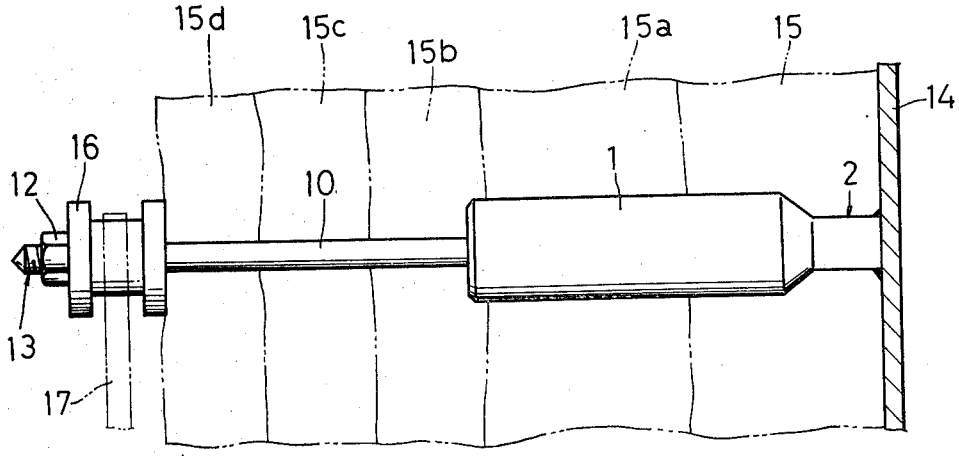
FIG. 5 is a side elevational view showing an embodiment of the assembled support according to the present invention.

In case of installation, the head 2 of the cylindrical holder 1 is welded to the inner surface of the furnace wall 14 of an electric furnace as shown in FIGS. 2 and 5. After a plurality of cylindrical holders 1 are fixed to the inner surface of the furnace wall 14, heat insulating layers 15 and 15*a* made of material such as ceramic fiber are laminated on the inner surface of the furnace wall 14 such that the forward end (left-hand side in FIG. 5) of each cylindrical holder 1 is not embedded in the layer 15*a*. Then the threaded portion 11 of the stud bolt 10 is inserted into the central hole 6 of the insulator 4 in the cylindrical holder 1 to be engaged with the nut 7 in the insulator 3 (see FIG. 2). Since the insulator 3 having the nut 7 is prevented from relative rotation with respect to the cylindrical holder 1 as hereinabove described, the stud bolt 10 is easily screwed into the nut 7. Then further insulating layers 15*b*, 15*c* and 15*d* are laminated in certain thickness being pierced by the stud bolt 10, and a hook insulator 16 having flanges on both sides is put over the forward end (the left-hand side in FIG. 5) of the stud bolt 10 and the threaded portion 13 of the stud bolt 10 is engaged with the nut 12. By virtue of this, the heat insulating layers 15 and 15*a* to 15*d* are fixed to the inner surface of the furnace wall 14. Then a metallic heating element 17 such as nichrome wire and Kanthal wire is hung on the hook insulator 16.

Attention is now drawn to FIGS. 6 to 8 in which a second embodiment of the present invention is shown. In place of the nut 7 in the first embodiment, a U-shaped set member 24 made of elastic material such as a metal plate and inwardly bent at both ends to give a pair of pawls (see FIG. 7) is provided in the insulator 3 as shown in FIG. 6. The stud bolt 10 has a pair of recesses 25 in the outer periphery of one end in place of the threaded portion 11. The stud bolt 10 is inserted into the cylindrical holder 1 so that the recesses 25 are engaged with the pawls 24*a* of the set member 24 to prevent displacement of the stud bolt 10 from the cylindrical holder 1. When the stud bolt 10 is to be extracted from the cylindrical holder 1, the stud bolt 10 is rotated by 90 degrees in the clockwise or anticlockwise direction so that the recesses 25 are disengaged from the pawls 24*a*.

The recesses 25 formed in the stud bolt 10 may be substituted for by tapered surfaces provided in the outer periphery of the bolt 10 as shown in FIG. 9. Further, the stud bolt 10 may be provided in its end with a pin 27 engageable with the pawls 24*a* of the set member 24 as shown in FIG. 10.

FIGS. 11 to 13 show a modification of the means for securing the hook insulator 16 to the stud bolt 10. The hook insulator 16 is provided in the inner peripheral surface of its central hole with a pair of opposite grooves 28 through the entire length as shown in FIGS. 11 to 13. On the other hand, the stud bolt 10 is provided with a pair of projections 30 which are engageable with the grooves 28. The hook insulator 16 is put over the stud bolt 10 so that the grooves 28 are engaged with the projections 30, and is rotated by 90 degrees to be secured to the stud bolt 10. The hook insulator 16 has in one end a pair of depressions 29 which are perpendicular to the grooves 28. The depressions 29 function to prevent relative rotation of the insulator 16 with respect to the stud bolt 10 upon engagement thereof by receiving the projections 30, and thereby prevent accidental displacement of the insulator 16.

The projections 30 of the stud bolt 10 may be flat in shape as shown in FIG. 15.

Further, as shown in FIGS. 16 to 18, the stud bolt 10 may have a through-hole 32 in its forward portion into which a pin 33, a split pin 34 or an L-shaped pin 35 is inserted to prevent displacement of the hook insulator 16 after the same is put over the stud bolt 10.

Since the heating element 17 is doubly insulated from the cylindrical holder 1 fixed to the furnace wall 14 by the hook insulator 16 and the insulators 3 and 4, the stud bolt 10 will not cause a leak of electricity to the furnace wall 14 even if the heating element 17 contacts the stud bolt 10 by breakage or displacement of the hook insulator 16.

Further, since the stud bolt 10 is detachably secured to the cylindrical holder 1, the stud bolt 10 alone may be replaced at need. By virtue of this, the support according to the present invention has the following advantages:

(a) When the hook insulator 16 is broken and the nut 12, the pin 33, the split pin 34 or the L-shaped pin 35 in the stud bolt 10 is fastened with rust by thermal influence within the furnace, the hook insulator 16 can be easily replaced for repair by disengaging the stud bolt 10 from the cylindrical holder 1.

(b) The support according to the present invention can be applied to various kinds of furnaces by utilizing a stud bolt of proper length in proportion to the thickness of the heat insulating layers.

While the invention has been described with reference to a few preferred embodiments thereof, it is to be understood that modifications or variations may be easily made without departing from the scope of this invention which is defined by the appended claims.

What is claimed is:

1. A support for a heating element in an electric furnace, said support comprising:

a cylindrical holder made of heat resisting metal and fixed to the wall surface of said electric furnace;

a pair of separated insulators secured within said cylindrical holder and having central holes respectively;

a stud bolt made of heat resisting metal of which one end being detachably engaged through said central holes with a member provided within one of said insulators;

heat insulating layers being laminated on said wall surface of said electric furnace over the other end of said stud bolt; and a hook insulator mounted to said other end of said stud bolt for hanging said heating element.

2. The invention as defined in claim 1 wherein the head of said cylindrical holder is contracted to be in some degree flat and welded to said wall surface of said electric furnace.

3. The invention as defined in claim 1 wherein said member is a nut coaxial with said central holes and prevented from rotating.

4. The invention as defined in claim 3 wherein one end of said stud bolt is threaded to be engaged with said nut.

5. The invention as defined in claim 1 wherein said member is a U-shaped set member made of elastic material and has a pair of pawls in both ends.

6. The invention as defined in claim 5 wherein said stud bolt has in the outer periphery of its end a pair of recesses to be engaged with said set member.

7. The invention as defined in claim 5 wherein said stud bolt has tapered surfaces in its outer periphery for engagement with said set member.

8. The invention as defined in claim 5 wherein said stud bolt has a pin in its end for engagement with said pawls.

9. The invention as defined in claim 1 wherein said hook insulator has a pair of opposite grooves provided through its entire length, said stud bolt has a pair of projections engageable with said grooves and said hook insulator further has in one end a pair of depressions which are perpendicular to said grooves.

* * * * *